US005647798A

United States Patent [19]

Falciglia

[11] Patent Number: 5,647,798

[45] Date of Patent: Jul. 15, 1997

[54] APPARATUS FOR PLAYING BINGO ON A SLOT MACHINE

[75] Inventor: Sal Falciglia, Ridgewood, N.J.

[73] Assignee: Slingo, Inc., Ridgewood, N.J.

[21] Appl. No.: 614,322

[22] Filed: Mar. 12, 1996

Related U.S. Application Data

[63] Continuation of Ser. No. 402,085, Mar. 10, 1995, abandoned.

[51] Int. Cl.[6] ..... G07F 17/34; A63F 3/06

[52] U.S. Cl. ..... 463/19; 463/20; 463/22; 273/143 R; 273/269; 273/138.2

[58] Field of Search ..... 273/193 R, 269, 273/138.1, 138.2; 463/18, 19, 20, 22

[56] References Cited

U.S. PATENT DOCUMENTS 4,743,024 5/1988 Helm et al. ..... 273/143 R
4,953,869 9/1990 Muhammed ..... 273/269
5,393,057 2/1995 Marnell, II ..... 273/85 CP

FOREIGN PATENT DOCUMENTS 464935 1/1992 European Pat. Off. ..... 273/269
2137392 10/1984 United Kingdom ..... 273/143 R

*Primary Examiner*—Benjamin H. Layno
*Attorney, Agent, or Firm*—Dilworth & Barrese

[57] ABSTRACT

A method and apparatus for playing the game of bingo on a slot machine is disclosed. The bingo slot machine includes a display matrix capable of generating random numbers and a plurality of wheels, the number of wheel corresponding to the number of columns used in the display matrix, and a slot machine activating arm for use to activate the wheels as would be typically found in a slot machine. The game is played by pulling the arm and activating the wheels which stop at random wheel positions. The positions are then compared to the display matrix in a fashion similar to the game of bingo.

9 Claims, 4 Drawing Sheets

| | | | | |
|---|---|---|---|---|
| 5 | 17 | 37 | 60 | 72 |
| 15 | 23 | 43 | 56 | 66 |
| 9 | 16 | 31 | 51 | 62 |
| 1 | 25 | 36 | 58 | 74 |
| 3 | 29 | 40 | 49 | 69 |

FIG.2A

| | | | | |
|---|---|---|---|---|
| 5 | 17 | 37 | 60 | 72 |
| 15 | 23 | 43 | 56 | 66 |
| 9 | 16 | 31 | 51 | 62 |
| 1 | 25 | 36 | 58 | 74 |
| 3 | 29 | 40 | 49 | 69 |

FIG.2B

| | | | | |
|---|---|---|---|---|
| 5 | 17 | 37 | 60 | 72 |
| 15 | 23 | 43 | 56 | 66 |
| 9 | 16 | 31 | 51 | 62 |
| 1 | 25 | 36 | 58 | 74 |
| 3 | 29 | 40 | 49 | 69 |

FIG.2C

| | | | | |
|---|---|---|---|---|
| 5 | 17 | 37 | 60 | 72 |
| 15 | 23 | 43 | 56 | 66 |
| 9 | 16 | 31 | 51 | 62 |
| 1 | 25 | 36 | 58 | 74 |
| 3 | 29 | 40 | 49 | 69 |

FIG.2D

| | | | | |
|---|---|---|---|---|
| 5 | 17 | 37 | 60 | 72 |
| 15 | 23 | 43 | 56 | 66 |
| 9 | 16 | 31 | 51 | 62 |
| 1 | 25 | 36 | 58 | 74 |
| 3 | 29 | 40 | 49 | 69 |

FIG.3A

| | | | | |
|---|---|---|---|---|
| 5 | 17 | 37 | 60 | 72 |
| 15 | 23 | 43 | 56 | 66 |
| 9 | 16 | 31 | 51 | 62 |
| 1 | 25 | 36 | 58 | 74 |
| 3 | 29 | 40 | 49 | 69 |

FIG.3B

| | | | | |
|---|---|---|---|---|
| 5 | 17 | 37 | 60 | 72 |
| 15 | 23 | 43 | 56 | 66 |
| 9 | 16 | 31 | 51 | 62 |
| 1 | 25 | 36 | 58 | 74 |
| 3 | 29 | 40 | 49 | 69 |

FIG.3C

| | | | | |
|---|---|---|---|---|
| 5 | 17 | 37 | 60 | 72 |
| 15 | 23 | 43 | 56 | 66 |
| 9 | 16 | 31 | 51 | 62 |
| 1 | 25 | 36 | 58 | 74 |
| 3 | 29 | 40 | 49 | 69 |

FIG.3D

APPARATUS FOR PLAYING BINGO ON A SLOT MACHINE

This is a continuation of application Ser. No. 08/402,085 filed on Mar. 10, 1995 now abandoned.

BACKGROUND OF THE INVENTION

1. Field of the Invention

The present invention relates to the game of bingo and, more specifically, to a method and apparatus for playing the game of bingo on a slot machine or the like.

2. Description of the Prior Art

The game of bingo has for many years been a popular game to play by people of all ages. Bingo's popularity as a gambling game has grown to the point where gambling casinos have set up bingo games in recent years as an added attraction for their players. However, attempts to implement the game of bingo into a slot machine have been few and unsuccessful.

For example, U.S. Pat. No. 4,743,024 to Helm et al. discloses an amusement arcade machine for playing the game of bingo. As disclosed, the machine comprises a display panel having a fixed matrix of numbers corresponding to row and column positions, a handle, and two spin reels, one reel corresponding to a row position number and one reel corresponding to a column position number. The game is played by causing the machine to spin one or both of the reels in an attempt to match the numbers on the fixed display matrix. However, the game does not use random bingo cards typically found in the game of bingo and relies on the player's skill in attempting to stop the spinning reels at the right time to win the game. Accordingly, it is believed that the machine disclosed in U.S. Pat. No. 4,743,024 fails to recreate the fun and enjoyment associated with the game of bingo. Further, the disclosed machine cannot be played by more than one player.

Accordingly, its an object of the present invention to provide a method and apparatus for playing the game of bingo on a slot machine or the like.

It is another object of the invention to provide a method and apparatus to play the game of bingo on a slot machine a player can utilize one or more display matrices.

It is another object of the present invention to provide a method and apparatus to play the game of bingo on a slot machine where two or more players can compete against each other.

SUMMARY OF THE INVENTION

The above and other objects are met by the present invention wherein a slot machine having a display matrix capable of generating random numbers is incorporated with a plurality of wheels, the number of wheels corresponding to the number of columns used in a display matrix, and a slot machine activating arm for use to activate the wheels as would be typically found in a slot machine.

The game begins when a player presses an activating button on the machine which causes the display matrix to generate a matrix of randomly chosen numbers as typically found on a bingo card. Thereafter, if the player wishes to play, the player places money into the machine and pulls the activating arm which causes the plurality of wheels to spin. The machine then stops the wheels at random wheel positions and determines whether the number displayed by each randomly selected wheel position corresponds to one of the numbers; displayed in the display matrix. The player continues the process entering money into the machine for each spin and hoping at one point to complete a horizontal line, vertical line, diagonal line, or other bingo-like combination to win the game. Optionally, each spinning wheel can include various other positions in addition to numbers which either increase the player's winnings or result in a penalty. For example, a spinning wheel could include a free spin position which would allow the player an extra spin if this position was selected by a spinning wheel. In another example, a wheel can include a lose all position to immediately erase the player's winnings.

BRIEF DESCRIPTION OF THE DRAWINGS

Preferred embodiments of the present method and apparatus for playing the game of bingo on a slot machine will be described in detail below with reference to the drawings wherein:

FIGS. 2A–2D are illustrations showing certain winning bingo combinations.

FIGS. 3A–3D are illustrations of various ways to select which boxes within the display matrix are to be covered before playing a one player slot machine embodiment.

DESCRIPTION OF THE PREFERRED EMBODIMENTS

Figure 1:
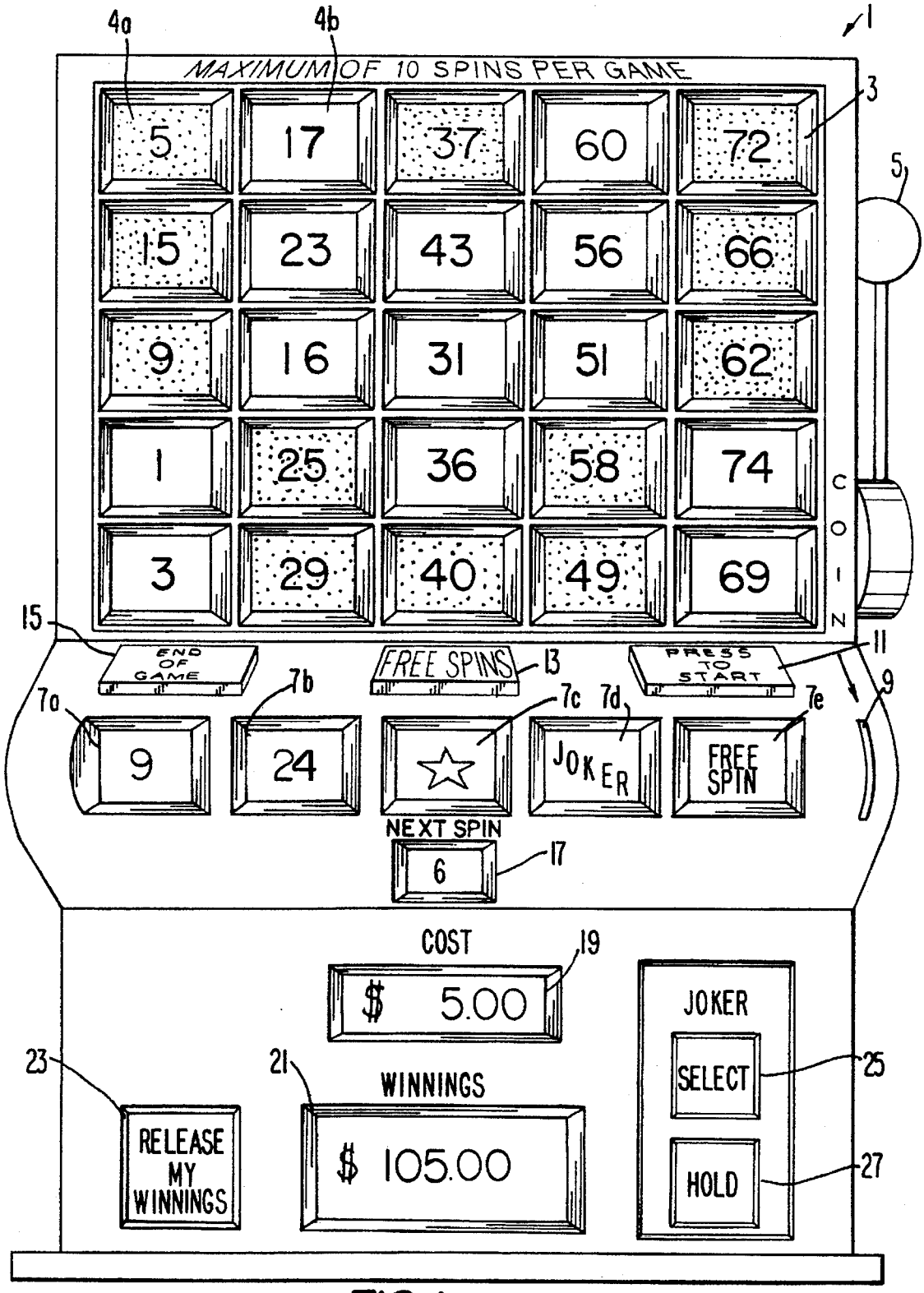
FIG. 1 is a from view of an embodiment of the present invention showing a slot machine designed for playing the game of bingo.

FIG. 1 is a front view of a preferred embodiment of the present invention showing a slot machine design for playing the game of bingo. The slot machine includes display matrix 3 comprised of five rows of blocks by five columns of blocks as would be typically found on a bingo game card, with an exemplary block 4*a* being "covered"; i.e. the block 4*a* shows the number "5" to appear darkened or with a dark background; and with an exemplary block 4*b* being uncovered; i.e. the block 4*b* shows the number "17" to appear less dark or with a light background compared with the covered block 4*a*. As will become readily apparent to those skilled in the art, the display matrix can be a series of television screens for displaying numbers within each block, a single screen subdivided into blocks for displaying numbers, individual display screens per block, or other display systems as would be found on slot machines, video games, computer systems, and the like. The display matrix is designed so that when activated, random numbers are displayed in each block of the display matrix. Preferably, the numbers range from 1 to 75 and are limited to a specific range within a column of blocks. For example, of the five blocks corresponding to the first column of the display matrix, the possible numbers available for each block would range from 1 to 15. The second column of blocks would range from numbers 16 to 30, the third column of blocks would range from numbers 31 through 45, the fourth column would range from numbers 46 through 60, and the fifth column would range from numbers 61 through 75. As in the game of bingo, the machine is designed such that no number will appear twice within the display matrix.

The machine is also configured with a slot machine activating arm 5 and coin slot 9 as would be typically found in a slot machine. Further, the machine includes five separate slot machine wheels (not shown) each having a display window, 7*a*, 7*b*, 7*c*, 7*d*, and 7*e*. Each wheel and window correspond to a column of the display matrix 3. Therefore, the first wheel and window 7*a* would correspond to the first column of the display matrix, the second wheel and window 7*b* would correspond to the second column, and so forth. Modifications to existing five wheel slot machines, for example the Bally Manufacture Corporation's five wheel slot machines model Nos. 1019-1 and 1019-222, are possible but preferably, a custom slot machine design would be used to implement the present invention.

The machine also includes a "Free Spin" combination display light and button 13 and an "End Of Game" display light 15. Other combination display light and buttons on the machine include a "Press To Start" button 11, Joker "Select" and "Hold" buttons 25 and 27 respectively, and a "Release My Winnings" button 23. Further, in addition to the five wheel display windows, there is a "Next Spin" window 17, a "Cost" per spin window 19, and a cumulative "Winnings" window 21.

Each wheel corresponding to display windows 7*a*–7*e* includes a range of numbered positions which corresponds to the range of numbers within each column. For example, the first wheel corresponds to the first column of the display matrix and includes numbered positions in the range of the first column, that is, positions numbered 1 through 15. Similarly, the second wheel corresponds to the second column and includes positions numbered 16 through 30, the third wheel corresponds to the third column and includes positions numbered 31 through 45, the fourth wheel corresponds to the fourth column in the display matrix and includes positions numbered 46 through 60, and the fifth wheel corresponds to the fifth column and includes positions numbered 61 through 75.

It has been found that a bingo game played on the slot machine in this and similar embodiments can be enhanced when the wheels include special positions in addition to the numbered positions. Examples of special positions which have been found to enhance the. game include a "Free Spin" position, as shown in window 7*e*, which would allow the player an extra spin if displayed, a lose winnings or "Devil" position (not shown) which would immediately eliminate any cumulative winnings, a "Gold Star" position, as shown in window 7*c*, which would allow the player additional winnings if displayed, a "Lemon" position (not shown) which has a null value, and a "Joker" position, as shown in window 7*d*, which would allow a player to select any uncovered block within the display matrix column corresponding to the wheel. In a preferred embodiment, the first, third, and fifth wheels would each include positions for three Jokers, one Gold Star, and one Lemon, and the second and fourth wheels would each include positions for two Jokers, one Free Spin, one Devil, and one Gold Star. Accordingly, each wheel would have a total of twenty possible positions. The following Table 1 summarizes the positions on each wheel:

TABLE 1

| 1st Wheel Positions | 2nd Wheel Positions | 3rd Wheel Positions | 4th Wheel Positions | 5th Wheel Positions |
|---|---|---|---|---|
| 1 thru 15 | 16 thru 30 | 31 thru 45 | 46 thru 60 | 61 thru 75 |
| 3 Jokers | 2 Jokers | 3 Jokers | 2 Jokers | 3 Jokers |
| 1 Gold Star | 1 Gold Star | 1 Gold Star | 1 Gold Star | 1 Gold Star |
| 1 Lemon | 1 Devil | 1 Lemon | 1 Devil | 1 Lemon |
| | 1 Free Spin | | 1 Free Spin | |

Further, it has been found that increasing the cost per spin as the game is played adds to the excitement of the game. An example increase schedule which has been found to work well is: five dollars for the first through fifth spins, ten dollars for the sixth and seventh spins, and twenty dollars for the eighth, ninth and tenth spins. As discussed below, no more than ten spins are possible. To alert the player of the increasing cost per spin, the cost for the next spin is displayed in the Cost window 19.

With the above in mind, playing bingo on the apparatus of the present invention can now be described. The object of the game is to match and cover all the numbers on the display matrix with a maximum of only 10 spins. There are 13 possible winning combinations: covering a complete row of five blocks (five combinations), coveting a complete column of five blocks (five combinations), and covering a diagonal line of five blocks in either direction (two combinations), or completely coveting the entire display matrix. FIGS. 2A, 2B, 2C, and 2D show respectively example horizontal, vertical, and diagonal winning combinations. As will be come readily apparent to those skilled in the art, additional or fewer possible winning combinations can be used.

To begin playing the game, a player presses the Press To Start button 11 which causes the machine to activate the display matrix and generate 25 random numbers in each of the blocks of the display as discussed above. After the display matrix displays a new set of randomly chosen numbers and the player decides to play, the player must insert a coin or chip to the coin slot 9. If for any reason the player does not begin to play, the numbers on the screen return to a random flashing mode after approximately 16 seconds.

After inserting a coin or chip, the machine will then "cover" preferably 12 blocks of the display matrix before the first spin. It has been found that providing a player with 12 pre-covered blocks enhances the game playing by increasing the odds in favor of the player. Further, it has been found that it is preferred that the machine, in deciding which of the 25 blocks within the matrix to cover, does not cover more than three blocks in any column or row and not more than two blocks in any diagonal line. Further still, it has been found that the particular pattern shown in FIG. 1 and FIG. 3A, wherein the first three blocks of the first and fifth columns are covered, the last two blocks of the second and fourth columns are covered, and the first and last blocks of the third column are covered, enhances the odds of winning and makes the game more exciting to play. As will become readily apparent to those skilled in the art, the symmetrical pattern shown in FIG. 1 and FIG. 3A can be inverted as shown in FIG. 3B or rotated 90 degrees in either direction as shown in FIG. 3C and FIG. 3D and still result in the same enhanced game excitement.

After the display matrix pre-covers 12 blocks, the Next Spin window 17 then lights up with a message "Ready To Play" and the player can now pull the arm 5 to start the game. Pulling the arm 5 causes the five wheels to begin spinning in a known slot machine type manner. Further, the Next Spin window 17 will advance one number and the Cost window 19 is updated to indicate the required amount to be inserted before another spin can be taken. The game has a maximum of 10 spins including any free spins taken. After 10 spins, the game is over and the End of Game light 15 will flash.

After the five wheels spin for a period of time, the machine stops the wheels at a randomly selected position such that one of the twenty possible wheel positions are displayed in each wheel's respective display window 7*a*–7*e*.

If a selected numbered wheel position matches a number within the wheel's corresponding column in the display matrix, that number in the display matrix column will then be covered. Thus, for example, if the first wheel displays a number which corresponds to a number in the first column of the display matrix, that number in the display matrix is then covered. Similarly, if the second wheel displays a number which corresponds a number to the second column of the display matrix, that number in the second column of the display matrix is covered, and so on for the third through fifth wheels.

If a Free Spin position is displayed, a light in the Free Spin combination display light and button 13 lights up. Preferably, a player is allowed to accumulate two free spins on any pull of the arm. Accordingly, two lights can be used within the Free Spin button 13 to show the availability of up to two free spins. If a player decides to use a free spin, the player merely presses the free spin button instead of inserting a coin or chip and pulls the arm 5 as discussed above.

If a Joker position is displayed by a wheel, the player then has the option to select which of the blocks within the column corresponding to the Joker is to be covered. Specifically, by pressing the Select button 25, the player can select through the available uncovered numbered blocks within the corresponding column until the particular block the player is interested in is covered. The player then presses the Hold button 27 to select the block. For example, if the player received a Joker in the fourth column as shown in FIG. 1, the player would press the Select button 25 which would then cause the number 60 block to be covered. By pressing the Select button 25 again, the number 56 would be covered. By pressing the Select button 25 yet again, the number 51 would be covered. By pressing the Select button 25 yet again, the number 60 would then be re-covered and so on until the player decides which number block is to be covered by pressing the hold button 27.

After the spin is complete and the player has selected which block to cover if there is a Joker, the machine then determines whether the player has a bingo combination, that is, whether five blocks either in a row, in a column, or diagonally are now covered. If the player does have a bingo combination, the machine automatically updates the winnings window 21 with the winnings associated with the particular bingo combination.

All prize money won from each spin accumulates and is displayed in the winnings window 21. A player can take their winnings after any spin, ending the game, by pressing the Release My Winnings button 23.

It has been found that the following winnings schedule provides a balance between winning, losing, and investing in each spin: five dollars for each number covered; five dollars for each Gold Star; twenty dollars for each five block row, column, or diagonal combination; fifty dollars for two diagonal combinations; one hundred dollars for filling the display matrix in 10 spins; five hundred dollars for filling the display matrix in 9 spins; one thousand dollars for filling the display matrix in 8 spins; five thousand dollars for filling the display matrix in 7 spins; ten thousand dollars for filling the display matrix in 6 spins; and twenty five thousand dollars for filling the display matrix in 5 spins.

As will become readily apparent to those skilled in the art, more than one display matrix can be implemented on a single machine to allow a player to play more than one bingo display. This embodiment would allow further mimicking of the typical game of bingo where a bingo player often plays more than one bingo card to increase the chance of winning.

Figure 4:
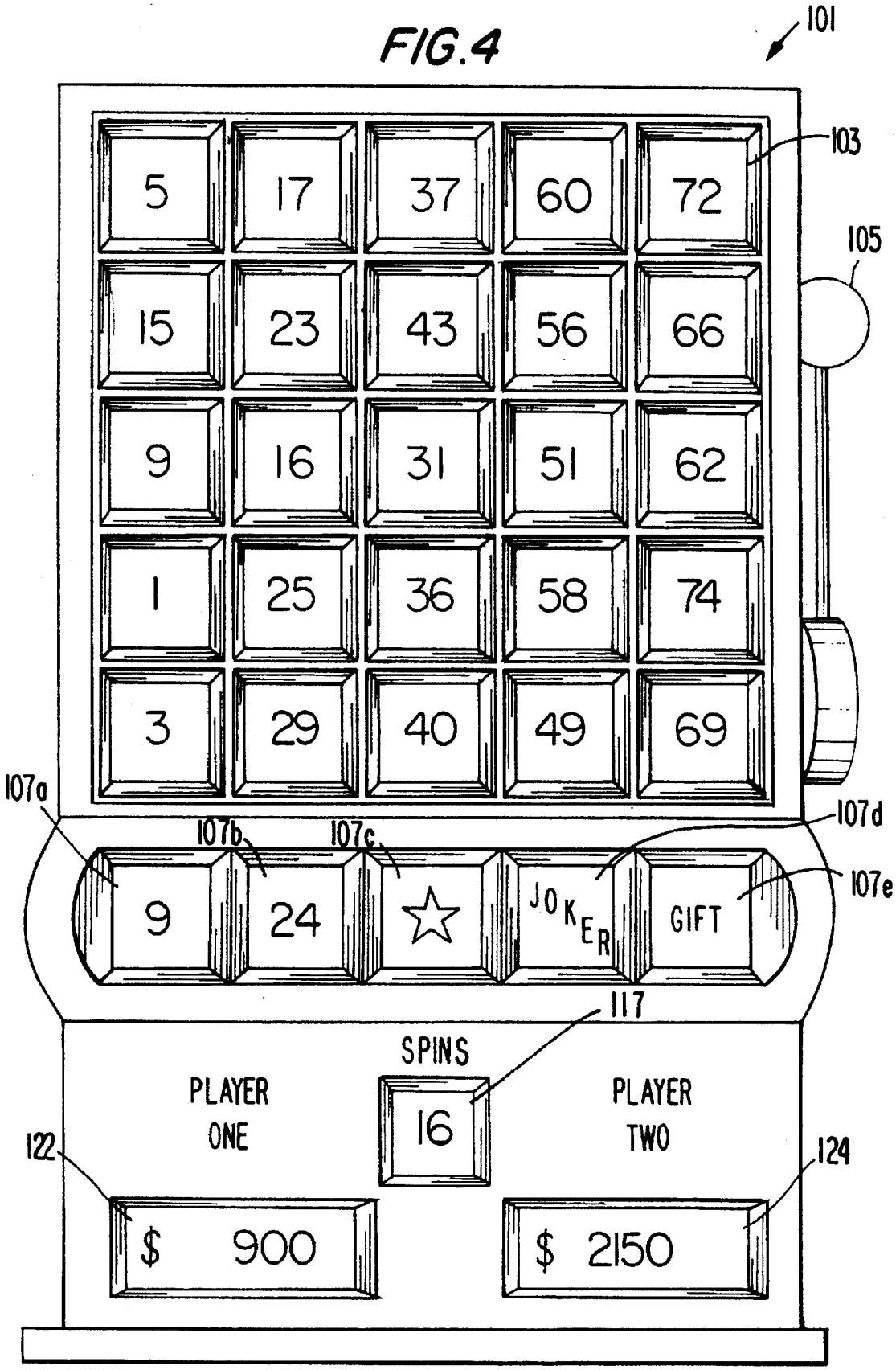
FIG. 4 is a front view of an alternate embodiment of the present invention showing a slot machine designed for playing the game of bingo with two or more players.

FIG. 4 illustrates an alternative two-player embodiment. Specifically, FIG. 4 is an illustration of a embodiment of the present invention for use in a television game show. The bingo slot machine 101 includes a display matrix 103, an activating arm 105, wheel position display windows **107*a*–107*e*, a number of spins window 117, and two player cumulative winning windows 122 and 124**.

This embodiment is played in a similar manner as described above. However, instead of 12 pre-covered positions, the display matrix 103 is completely uncovered at the beginning of the game. Further, the maximum number of spins is 16 plus additional free spins not to exceed a total of 20 spins per game. Finally, other special wheel positions, for example a free gift as shown in wheel display window **107*e***, can be used as is typical in television game shows.

The following Table 2 fists the various wheel positions for a preferred embodiment of the two player game.

TABLE 2

| 1st Wheel Positions | 2nd Wheel Positions | 3rd Wheel Positions | 4th Wheel Positions | 5th Wheel Positions |
|---|---|---|---|---|
| 1 thru 15 | 16 thru 30 | 31 thru 45 | 46 thru 60 | 61 thru 75 |
| 3 Jokers | 3 Jokers | 3 Jokers | 2 Jokers | 3 Jokers |
| 1 Gold Star | 1 Gold Star | 1 Gold Star | 1 Gold Star | 1 Gold Star |
| 1 Gift | 1 Devil | 1 Free Spin | 1 Devil | 1 Gift |
| | | | 1 Free Spin | |

In the two or more player embodiment, the object of the game is to win the most money. As with the single player embodiment, there are various ways to win money: cover a vertical or horizontal fine of blocks in the display matrix, cover a diagonal line of blocks in the display matrix, cover all of the blocks in the display matrix, spin a Gold Star, or spin a Free Gift. Preferably, a player can only win one free gift per round and will only collect on the gift if the player wins the round. Optionally, the value of the gift can be included in a player's cumulative winnings.

Other differences between the one player and the two-player embodiment rules include the following are: when a player spins a Free Spin, the player must use the free spin immediately or lose it; when a player spins a Devil, only wheels displaying matching numbers or a Joker are valid but no money value is received, all other wheel positions are void and the player's accumulated winnings including gifts are erased.

Further, after 16 spins, including free spins, either player can buy additional extra spins at a preferred rate of one-hundred dollars per spin assuming the player has accumulated more than $100.00 and no more than twenty spins in total have not taken place.

The game is played in a series of rounds, preferrably three, with each player accumulating wigs. After three rounds, the player with the highest winnings is allowed to keep his winnings and advance to a single player final round. The values for receiving a winning combination change between the rounds. In the first round, the preferred winning schedule is: fifty dollars for each numbered covered, two-hundred and fifty dollars for each line covered (vertical, horizontal, or diagonal) or Gold Star received, and one-thousand dollars for coveting the entire display matrix. The cost of an extra spin is one-hundred dollars. In the second round, the preferred winning schedule is: one-hundred dollars for each number covered, five-hundred dollars for each line covered or Gold Star received, and two-thousand dollars for coveting the entire display matrix. The cost of an extra spin is two-hundred dollars.

In the third round, the preferred winning schedule is: two hundred dollars for each number covered, one-thousand dollars for each line covered or Gold Star received, and four-thousand dollars for coveting the entire display matrix. The cost of an extra spin is three-hundred dollars.

The fourth and final round is played by the player with the highest accumulated winnings after the three rounds. The winning player plays the final round using the same machine except that before the player plays the game, twelve blocks are covered, preferrably in a manner as described above and illustrated in FIGS. 3A–3D. Further, the player is only allowed ten spins, including the use of a acquired or previously accummulated free spins, provided the player has not lost same by spinning a Devil position. The final round player can also buy up to three spins from the player's accummulated winnings: the first spin costing five-hundred dollars, the second spin costing one-thousand dollars, and the third spin costing one-thousand five-hundred dollars. Further, the winning schedule changes: two-thousand five-hundred for each Gold Star, five-thousand dollars for coveting both diagonals, and twenty-thousand dollars for covering the entire display matrix. If the player spins a Gift position, the player receives gifts that were not won in the previous three rounds.

Alternate variations on the game can be made. For example, one can vary the number of spins, the number of purchasable extra spins, and/or the amount of money awarded for winning combinations. In a preferred alternate final round, the final player can have sixteen spins and purchase four additional spins for a maximum of twenty free spins. In this embodiment, the first extra spin would cost four-hundred dollars, the second free spin would cost six-hundred dollars, the third free spin would cost one-thousand dollars, and the fourth free spin would cost two-thousand dollars.

As will become readily apparent to those skilled in the art, variations of the present method and apparatus can be designed and built without departing from the scope of the claimed invention. For example, various embodiments can be fully incorporated into software and played on a computer or similar device. Alternatively, various embodiments be implemented as a video game or hand-held video game with the program implemented as an integrated circuit game card, CD-ROM, or other similar video game format.

What is claimed is:

1. An apparatus for playing a bingo-style game comprising:

a display matrix having five columns and five rows, each column and row combination defining a block, the display matrix capable of displaying a number within each block of the matrix;

at least one first random number generator for generating random numbers to be displayed in each block of the display matrix;

at least one second random number generators being five wheels having number positions which can be randomly selected for generating and displaying at least one random number to be compared with the random numbers displayed in each block of the display matrix, the number of second random number generators corresponding to the number of columns within the display matrix, wherein the five wheels include special positions in addition to the numbered positions which include at least one position which allows a player to determine the number value;

an activator including an arm device connected to the five wheels for causing the wheels to first spin and then stop at a randomly selected wheel position; and a comparator for comparing the random numbers generated by the second random number generator with the random numbers displayed in the corresponding column of blocks of the display matrix and for causing the display matrix to automatically cover any block within the corresponding column having a random number displayed therein matching the random number generated by the corresponding second random number generator, and the comparator causes the display matrix to precover twelve blocks;

a determining device for determining whether five blocks are covered in a row, five blocks are covered in a column, five blocks are covered in a diagonal, or whether all of the blocks within the display matrix are covered, and for generating a bingo indication signal; and An indicator, responsive to the bingo indication signal, for indicating a bingo condition to a user.

2. A slot machine for playing a bingo-style game comprising:

a five column by five row random number display matrix;

a random number generator for generating five sets of random numbers for display by the five column by five row random number display matrix, wherein the five sets of random numbers are generated such that:

the first set includes random numbers ranging from 1 to 15;

the second set includes random numbers ranging from 16 to 30;

the third set includes random numbers ranging from 31 to 45;

the four set includes random numbers ranging from 46 to 60;

the fifth set includes random numbers ranging from 61 to 75; and each set of random numbers is generated without repetition within the respective set;

five wheels, each wheel corresponding to each column of the display matrix and each wheel having selectable positions and each wheel capable of spinning and stopping randomly to select one of the wheel positions;

an activating arm for causing the wheels to spin and then stop at randomly selected positions;

a slot receiving device for receiving credit and allowing a player to use the activating arm;

a comparator for comparing the numbers selected by the wheels with the numbers in the corresponding columns of the display matrix and if they match causing the display matrix to automatically cover the matching number in the display matrix; and a determining device for determining whether the display matrix has five numbers covered in a row, five numbers covered in a column, five numbers covered in a diagonal, or all of the numbers are covered, and for generating a bingo indication signal for indicating a bingo condition.

3. The slot machine according to claim 2 wherein the machine is implemented in software and played on a computer system.

4. The slot machine according to claim 2 wherein the machine is implemented as a video game.

5. A machine for playing a bingo-style game with two players on a single display matrix of rows and columns defining blocks comprising:

a first random number generator for generating sets of random numbers to be displayed in each block of the display matrix, the sets of random numbers are generated such that each set of random numbers has a distinct range from the other sets of random numbers, and each set of random numbers is generated without repetition within the respective set;

a second random number generator for generating and displaying a set of numbers, the size of the number set equal and corresponding to the number of columns within the display matrix;

a first activator for activating the second random number generator for one player;

a second activator for activating the second random number generator for a second player; and a comparator for comparing the random numbers generated by the second random number generator with the random numbers displayed in the corresponding column of blocks of the display matrix and for causing the display matrix to cover any block within the corresponding column having a number matching the corresponding number generated by the second random number generator.

6. A slot machine for playing a bingo-style game comprising:

a five column by five row random number display matrix;

a first random number generator for generating five sets of random numbers for display by the five column by five row random number display matrix, wherein the five sets of random numbers are generated such that:

the first set includes random numbers ranging from 1 to 15;

the second set includes random numbers ranging from 16 to 30;

the third set includes random numbers ranging from 31 to 45;

the four set includes random numbers ranging from 46 to 60;

the fifth set includes random numbers ranging from 61 to 75; and each set of random numbers is generated without repetition within the respective set;

an actuator for causing a second random number generator to generate five random numbers;

a slot receiving device for receiving credit and for allowing a player to use the actuator;

a comparator for comparing the five random numbers generated by the second random number generator with the numbers displayed in the corresponding columns of the display matrix and, responsive to a match of such random numbers, for causing the display matrix to automatically display the matching number as covered in the display matrix; and a determining device for determining whether the display matrix has five numbers covered in a row, five numbers covered in a column, five numbers covered in a diagonal, or all of the numbers are covered, and for generating a bingo indication signal for indicating a bingo condition.

7. The slot machine of claim 6 further comprising:

a processor for executing software implementing the first and second random number generators to generate random number signals corresponding to the random numbers generated.

8. The slot machine of claim 7 further comprising:

a display screen for displaying the display matrix;

wherein the processor operates in conjunction with the display screen to implement the slot machine as a video game.

9. The slot machine of claim 8 wherein the display screen displays uncovered random numbers with a white background, and displays covered random numbers with a non-white background.

* * * * *